United States Patent [19]

Fruchard

[11] Patent Number: 4,582,378

[45] Date of Patent: Apr. 15, 1986

[54] ELECTRICAL CONNECTOR ASSEMBLY AND AN EJECTOR BAR THEREFOR

[75] Inventor: Charles Fruchard, Conflans Sainte Honorine, France

[73] Assignee: AMP Incorporated, Harrisburg, Pa.

[21] Appl. No.: 575,088

[22] Filed: Jan. 30, 1984

[30] Foreign Application Priority Data

Feb. 9, 1983 [FR] France ..... 83 02038

[51] Int. Cl.[4] ..... H01R 13/62

[52] U.S. Cl. ..... 339/45 M; 339/91 R; 339/17 R

[58] Field of Search ..... 339/45, 46, 91 R, 74 R, 339/75 MP

[56] References Cited

U.S. PATENT DOCUMENTS

| | | | |
|---|---|---|---|
| 2,487,801 | 11/1949 | Healy | 173/328 |
| 2,897,033 | 7/1959 | Ford | 312/320 |
| 3,711,816 | 1/1973 | Shumacher | 339/45 M |
| 4,196,954 | 4/1980 | Collignon et al. | 339/45 M |
| 4,232,926 | 11/1980 | Inouye et al. | 339/45 M |
| 4,381,131 | 4/1983 | Demnianiuk | 339/91 R |

FOREIGN PATENT DOCUMENTS

| | | | |
|---|---|---|---|
| 420312 | 3/1967 | Fed. Rep. of Germany | 339/91 R |
| 2801427 | 7/1978 | Fed. Rep. of Germany | 339/45 M |
| 2385293 | 10/1978 | France | 339/91 R |
| 2028014 | 2/1980 | United Kingdom | 339/91 R |
| 2071928 | 9/1981 | United Kingdom | 339/74 R |

*Primary Examiner*—Gil Weidenfeld
*Assistant Examiner*—David L. Pirlot
*Attorney, Agent, or Firm*—Thomas G. Terrell

[57] ABSTRACT

A male electrical connector for mating with a female electrical connector has a latch arm with a spur for engaging in an opening in the female electrical connector. For separating the connectors the male connector has an ejector bar pivoted thereto. When the bar is depressed, the central part thereof depresses the latch arm to disengage the spur from the opening and camming heads on the ends of the bar engage end walls of the connector to lift the connector therefrom. The ejector bar has a central cam surface, and a camming head at each end having a trunnion for releasably connecting the bar to the male connector.

4 Claims, 6 Drawing Figures

FIG.2.
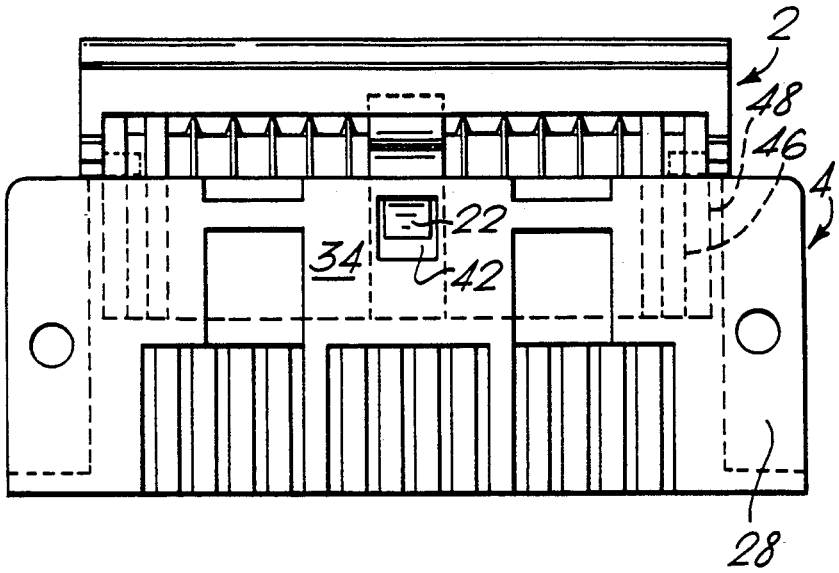
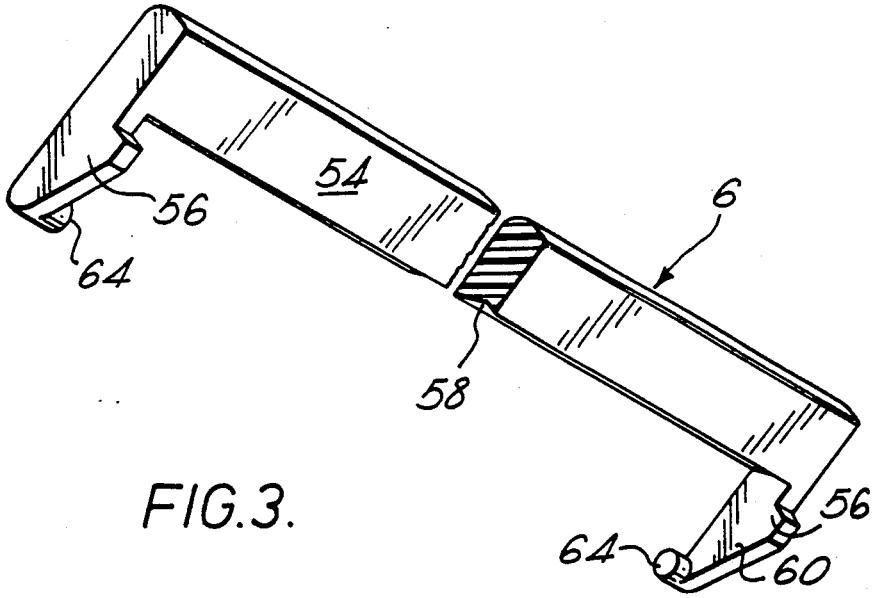
FIG.3.

ELECTRICAL CONNECTOR ASSEMBLY AND AN EJECTOR BAR THEREFOR

An electrical connector assembly and an ejector bar therefor.

A known electrical connector assembly comprises first and second elongate electrical connectors which can be secured together in mated relationship by latch means including a latch arm disposed intermediate the ends of one of the connectors and which is deflectable to allow the connectors to be disengaged from one another.

Especially where, as in the case for example of pin header assemblies for mounting on printed circuit boards, the connectors comprises a multiplicity of mating terminals, a substantial force is required to separate the mated connectors and the latch arm must be held manually in its deflected position at least initially. Also in separating such connectors there is a standing temptation to use the wires, which will normally project from one of the connectors as a handle, in which case the joints between the wires and the terminals of the connector may well suffer damage.

Stated broadly, the invention provides an electrical connector assembly as described above, comprising an ejector bar which can be operated both to deflect the latch arm and also to separate the mated connectors.

According to one aspect of the invention an electrical connector assembly as defined in the first paragraph of this specification is characterized by an ejector bar pivoted to the first connector and having at each end a transversely projecting lever, and intermediate the levers a cam surface, the ejector bar being, in the mated condition of the connectors, pivotable relative to the first connector, to cause the cam surface to deflect the latch arm and subsequently to cause the levers to engage the ends of the second connector to force the connectors relatively apart from one another. According to another aspect thereof, the invention provides, an ejector bar for an electrical connector assembly comprising first and second elongate electrical connectors which can be secured together in mating relationship by latch means including a latch arm disposed intermediate the ends of one of the connectors and which is deflectable to allow the connectors to be disengaged from one another; characterized in that the latch arm comprises a rectilinear bar portion, a concave cam surface formed at least at the longitudinal center of the bar portion, a camming arm projecting from each end of the bar portion normally thereof, and having an enlarged camming head of generally triangular shape and being provided at its apex, which is remote from the bar portion, with a trunnion extending parallel to the bar portion, the trunnions being directed towards one another in axial alignment, the cam surface being disposed between the arms which are resiliently deflectable relatively away from one another.

U.S. Pat. No. 4,168,887, U.S. Pat. No. 4,070,081 and Japanese Utility Model Publications Nos. 318.53/77 and 18958/77 disclose mating electric connectors which are arranged to be forced apart from one another by means of levers mounted on one of the connectors. In each case, however, a plurality of discrete levers is employed and none of these has a cam surface which acts upon a latch arm to permit the connectors to be disengaged from one another.

For a better understanding of the invention reference will now be made by way of example to the accompanying drawings in which;

FIG. 2 is an elevational view of the assembly showing the connector when mated with the header;

FIG. 3 is a perspective view of the ejector bar; and

Figure 1:
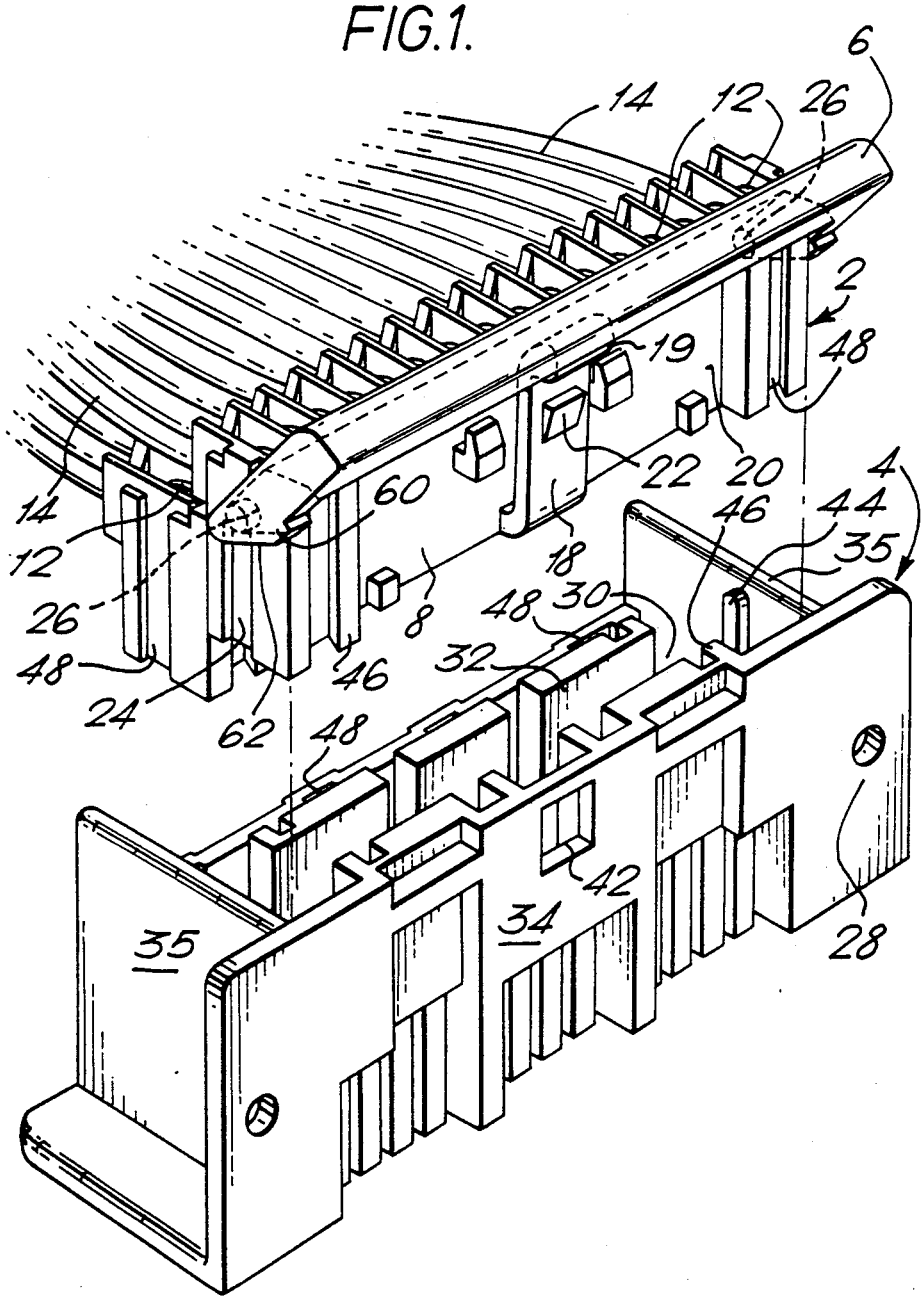
FIG. 1 is an exploded perspective view of an electrical connector and pin header, assembly comprising an ejector bar for ejecting the connector from the header.

As best seen in FIG. 1, the assembly comprises a male electrical connector 2, a female electrical connector in the form of a pin header 4, and an ejector bar 6 mounted to the connector 2.

Figure 4:
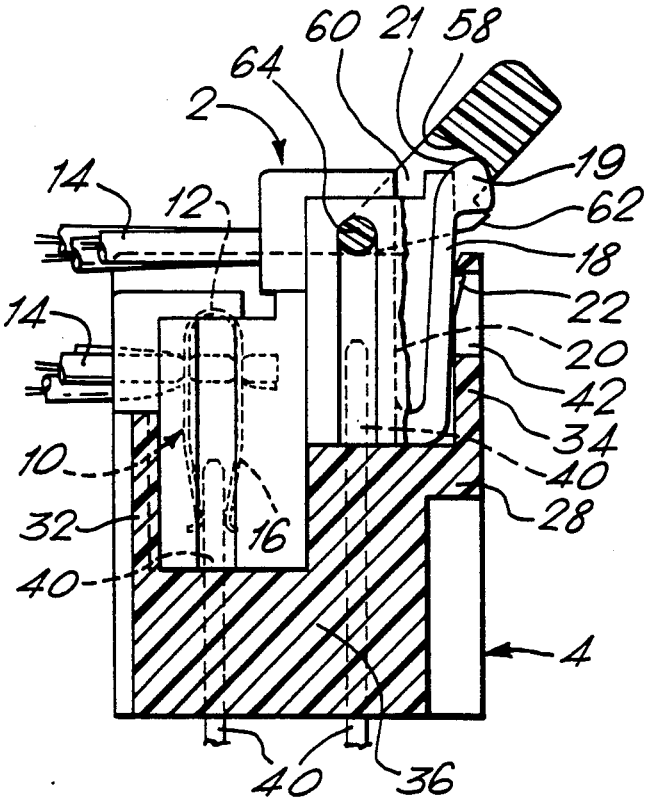
FIGS. 4 to 6 are cross-sectional views illustrating respective stages in the operation of the ejector bar.

The connector 2 comprises an insulating housing 8 containing rows of electrical terminals 10 (one of which is shown diagrammatically and in broken lines in FIG. 4) each comprising a slotted wire-receiving portion 12 into which an individual wire 14 has been forced by means of a wire insertion tool (not shown), and a pin receptacle portion 16. Extending from the longitudinal center of the lower (as seen in FIG. 1) part of the housing 8 is a cantilever latch arm 18 which normally diverges slightly (see FIG. 4) upwardly, from the adjacent wall 20 of the housing 8 and is provided intermediate its ends with a spur 22 on its side remote from wall 20, the free end of the arm 18 being formed as a camming head 19 having an upper cam surface 21. Formed in each end of the housing 8 is a vertical guide channel 24, in the upper, (as seen in FIG. 1) end of which is a socket 26.

The pin header 4 comprises an insulating housing 28 defining a longitudinal channel 30 having side walls 32 and 34, end walls 35 and a stepped base wall 36 from which project rows of pins 40 (some of which are shown in FIG. 4) which extend through the wall 36 for connection to the conductors of a printed circuit board (not shown). The wall 34 is formed with an opening 42 adjacent to its upper (as seen in FIG. 1) edge.

As will be apparent from FIG. 4, the connector 2 can be mated with the header 4 so that each receptacle 16 of the former mates with a corresponding pin 40 of the latter, the pins and receptacles being guided into mating relationships by cooperation between the channels 24 of the connector 2 and internal ribs 44 (one is shown in FIG. 1) provided at respective ends of the channel 30 of the header 4, as well as by cooperation between further guide ribs 46 and channels 48 on the connector 2 and the header 4.

In the fully mated position of the connector 2 and the header 4, the spur 22 on the arm 18 engages in the opening 42 in the wall 34 of the header to latch the connector 2 in the channel 30 (FIGS. 2 and 4).

After the wires 14 have been inserted, preferably simultaneously, into the wire-receiving portions 12, by a harness maker, and prior to the supply of the assembly, with the connector 2 and the header 4 unmated, to the harness maker's customer, the harness maker mounts the ejector bar 6 to the connector 2. The bar 6 would interfere with the wire insertion operation if it were mounted to the connector 2 prior thereto.

The bar 6, which is made of a plastics material, comprises a rectillinear bar portion 54 from either end of which a lever in the form of a camming arm 56 projects normally of the portion 54 (as best seen in FIG. 3) which is provided with a slightly concave inner cam surface 58 extending centrally between the arms 56.

Each arm 56 terminates in an enlarged camming head 60 of generally triangular shape and having a cam surface 62. The head 60 is provided at its apex, i.e., at its end remote from the bar portion 54, with a trunnion 64 extending parallel to the bar portion 54, the trunnions 64 being directed towards one another in axial alignment. The material of the bar 6 is such that the arms 56 and thus the trunnions can be deflected resiliently, relatively away from one another, so that the trunnions 64 can be inserted into the respective sockets 26 of the connector 2 rotatably to mount the bar 6 thereto, as well as for the purpose of dismounting the bar 6 from the connector 2.

Figure 5:
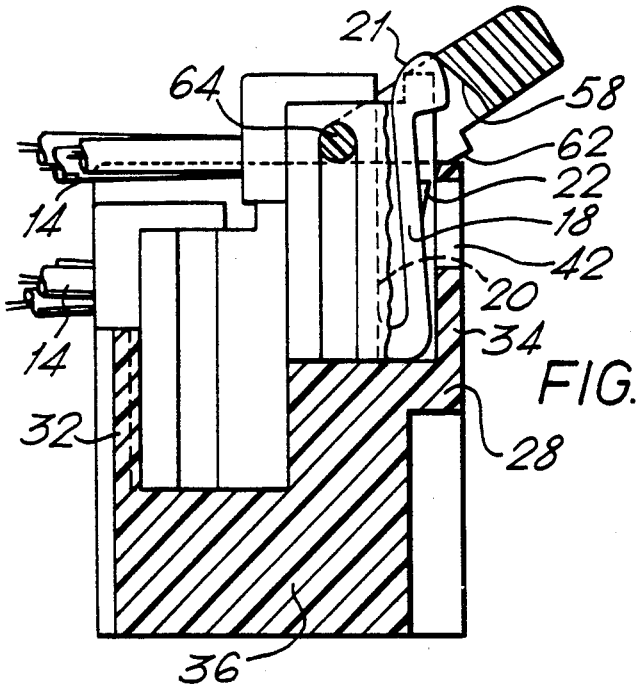
Figure 6:
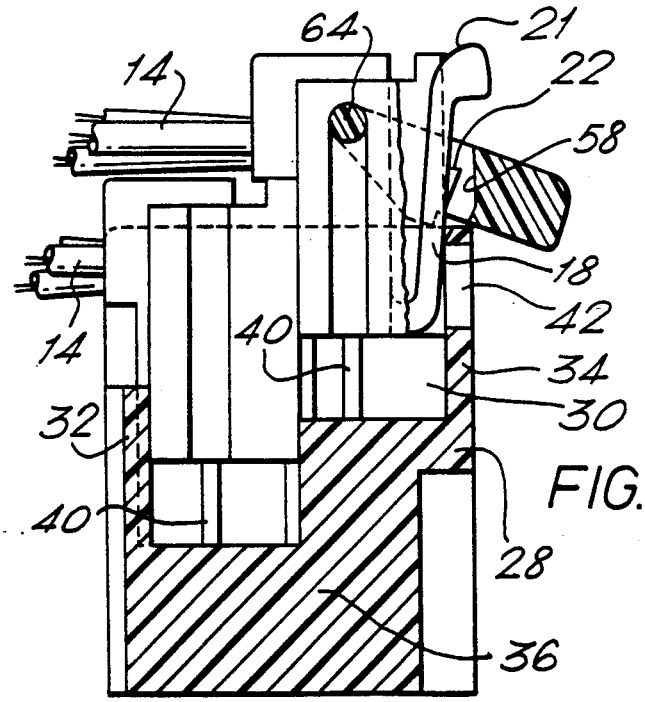

When the customer wishes to disengage the mated connector 2 and header 4, he depresses the portion 54 so as to rotate the bar 6 in a clockwise (as seen in FIGS. 4 to 6) sense, about the longitudinal axes of the trunnions 64, from its initial FIG. 4 position, so that the cam surface 58 of the bar portion 54 acts upon the cam surface 21 of the camming head 19 resiliently to deflect the latch arm 18 towards the wall 20 as shown in FIG. 5, so as to release the spur 22 from the opening 42. Following the release of the spur 22, the cam surfaces 62 of the camming heads 60 engage the top edges of the end walls 35 of the channel 30, so that as will be apparent from FIG. 6, the trunnions 64 lift the connector 2 from the channel 30. By virtue of mechanical advantage afforded by the length of the arms 56, the force required to depress the bar portion 54 is negligible.

I claim:

1. An electrical connector assembly comprising first and second elongate electrical connectors which can be secured together in mated relationship by latch means including a latch arm disposed intermediate the ends of one of the connectors and which is deflectable to allow the connectors to be disengaged from one another; characterized by an ejector bar comprising a bar portion having at each end a lever projecting normally thereof and being pivotally attached to a respective end of the first connector, and intermediate the levers a cam surface, the ejector bar being, in the mated condition of the connectors, pivotable relative to the first connector, to cause the cam surface to deflect the latch arm and subsequently to cause the levers to engage the ends of the second connector to force the connectors relatively apart from one another, each lever being provided with a trunnion which is received in a socket in said respective end of the first connector, the material of the ejector bar being such as to allow the levers and thus the trunnions to be relatively displaced resiliently away from one another so that the ejector bar can be dismounted from the first connector.

2. An assembly according to claim 1, characterized in that the cam surface is concave and is disposed centrally of the ejector bar and is engageable with a convex camming surface on a camming head on the free end of the latch arm which is in the form of a cantilever.

3. An ejector bar for an electrical connector assembly comprising first and second elongate electrical connectors which can be secured together in mated relationship by latch means including a latch arm disposed intermediate the ends of one of the connectors and which is deflectable to allow the connectors to be disengaged from one another; characterized in that the latch bar comprises a rectilinear bar portion, a concave cam surface formed at least at the longitudinal center of the bar portion, a camming arm projecting from each end of the bar portion normally thereof, and having an enlarged camming head of generally triangular shape and being provided at its apex, which is remote from the bar portion, with a trunnion extending parallel to the bar portion, the trunnions being directed towards one another in axial alignment, the cam surface being disposed between the arms which are resiliently deflectable relatively away from one another.

4. An electrical connector assembly comprising first and second elongate electrical connectors which can be secured together in mated relationship by latch means including a latch arm disposed intermediate the ends of one of the connectors and which is deflectable to allow the connectors to be disengaged from one another; characterized by an ejector bar pivotally attached to the first connector and having at each end a transversely projecting lever, and intermediate the levers a cam surface, the ejector bar being, in the mated condition of the connectors, pivotable relative to the first connector, to cause the cam surface to deflect the latch arm and subsequently to cause the levers to engage the ends of the second connector to force the connectors relatively apart from one another, and in which each lever is provided with a trunnion which is received in a socket in the first connector, the material of the ejector bar being such as to allow the levers to be relatively displaced away from one another so that the ejector bar can be dismounted from the first connector, the ejector bar being pivoted to the ends of the first connector, the cam surface, which is concave, being disposed centrally of the ejector bar and being engageable with a convex camming surface on a camming head on the free end of the latch arm which is in the form of a cantilever, and in which assembly the second connector is a female connector in the form of a pin header having a channel for receiving the first connector, a side wall of the channel having an opening adjacent to the mouth of the channel, the first connector comprising an insulating housing containing rows of electrical terminals each having a slotted wire receiving portion and a receptacle portion for mating with an individual pin of the pin header, the housing being provided with a spur for engagement in the opening in the mated condition of the connectors to secure the first connector in the channel, the latch arm being resiliently deflectable towards a wall of the first connector to allow it to be removed from the channel; the ejector bar being pivotable relative to the first connector to cause the cam surface to deflect the latch arm towards the wall of the first connector to displace the spur from the opening.

* * * * *